US008969746B2

(12) United States Patent
Puri et al.

(10) Patent No.: US 8,969,746 B2
(45) Date of Patent: Mar. 3, 2015

(54) SAFETY SWITCH HAVING A HOLD-CLOSED FUNCTION FOR POSITIVE OPENING OF CONTACT ELEMENTS; AND METHOD FOR POSITIVE OPENING OF CONTACT ELEMENTS OF A SAFETY SWITCH WITH A LOCKING FUNCTION

(75) Inventors: Werner Puri, Nürnberg (DE); Joachim Seidl, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 446 days.

(21) Appl. No.: 12/863,694

(22) PCT Filed: Jan. 29, 2008

(86) PCT No.: PCT/EP2008/000682

§ 371 (c)(1),
(2), (4) Date: Jul. 20, 2010

(87) PCT Pub. No.: WO2009/095032

PCT Pub. Date: Aug. 6, 2009

(65) Prior Publication Data

US 2010/0307899 A1 Dec. 9, 2010

(51) Int. Cl.
*H01H 27/00* (2006.01)

(52) U.S. Cl.
CPC ..... *H01H 27/007* (2013.01)
USPC ..... 200/43.04

(58) Field of Classification Search
USPC ..... 200/329, 43.01, 43.04, 43.11, 334, 200/43.07, 43.08, 43.13, 43.16, 43.18, 200/43.21
See application file for complete search history.

(56) References Cited

U.S. PATENT DOCUMENTS

| | | | | |
|---|---|---|---|---|
| 3,915,273 | A | 10/1975 | Loschengruber | |
| 4,524,251 | A | 6/1985 | Schulz | |
| 6,982,391 | B2 | 1/2006 | Da Dalt | |
| 7,064,286 | B2 * | 6/2006 | Dumont et al. | 200/331 |
| 2005/0109593 | A1 | 5/2005 | Da Dalt | |

FOREIGN PATENT DOCUMENTS

| | | | |
|---|---|---|---|
| DE | 3330109 | A1 | 3/1985 |
| DE | 3943376 | C1 | 6/1991 |
| DE | 3943375 | A1 | 7/1991 |
| EP | 1533826 | A1 | 5/2005 |
| FR | 2233558 | A1 | 1/1975 |

OTHER PUBLICATIONS

Chinese Office Action dated Sep. 29, 2012 corresponding to Application No. 200880122425.2.

* cited by examiner

*Primary Examiner* — Renee Luebke
*Assistant Examiner* — Lheiren Mae A Caroc
(74) *Attorney, Agent, or Firm* — Harness, Dickey & Pierce, P.L.C.

(57) ABSTRACT

The present invention, in at least one embodiment, relates to a safety switch with a hold-closed function, having a plunger element, which is held such that it can move, for positive opening and closing of contact elements, at least one locking element for locking and unlocking the plunger element, and a housing. At least one embodiment of the invention also relates to a method for positive opening and closing of contact elements of a safety switch with a hold-closed function, and to the use of a safety switch such as this.

20 Claims, 2 Drawing Sheets

SAFETY SWITCH HAVING A HOLD-CLOSED FUNCTION FOR POSITIVE OPENING OF CONTACT ELEMENTS; AND METHOD FOR POSITIVE OPENING OF CONTACT ELEMENTS OF A SAFETY SWITCH WITH A LOCKING FUNCTION

PRIORITY STATEMENT

This application is the national phase under 35 U.S.C. §371 of PCT International Application No. PCT/EP2008/000682 which has an International filing date of Jan. 29, 2008, which designates the United States of America, the entire contents of which is hereby incorporated herein by reference.

FIELD

At least one embodiment of the present invention generally relates to a safety switch having a hold-closed function, having a plunger element which is held such that it can move, for positive opening and closing of contact elements, at least one locking element for locking and unlocking the plunger element, and a housing. At least one embodiment of the invention also generally relates to a method for positive opening or closing of contact elements of a safety switch having a hold-closed function, with the safety switch having a plunger element which is held such that it can move and at least one locking element for locking and unlocking the plunger element, as well as to the use of a safety switch.

BACKGROUND

Safety switches having a hold-closed function are widely known and represent protective devices. They cause protective elements such as protective doors, protective grilles and other coverings to be held closed for as long as a dangerous state exists. The task of such safety switches having a hold-closed function is on the one hand to enable a machine or a process when the safety switch is closed and held closed, i.e. locked. On the other hand the machine or the process is to be disabled a safety switch is opened, i.e. a current flow is to be suppressed. Furthermore monitoring of the locking or of the holding closed should guaranteed by the safety switch.

Such known safety switches consist of a basic structure, i.e. a housing, with a drive head and also a separate actuator. The basic structure with drive head can be constructed from one or more parts and contains the switching contacts, i.e. the contact elements. The drive head has one or more openings, into which the actuator must be introduced to close the switching contacts.

The safety switch is generally mounted on the frame of a fixed protective device, the actuator on the movable protective element, i.e. for example on the movable protective doors which can be closed by the protective device. In the secure system state, with the danger area being screened off by the protective device, the actuator is pushed into the drive head of the safety switch. If the protective element, for example the protective doors, is opened the actuator is simultaneously withdrawn from the drive head. This positively opens the secure switching contact and the system is switched off or put into a safe state.

These safety switches with separate actuator are characterized by a number of requirements. On the one hand an at least dual encoding and on the other the often lateral and optionally the front face-side actuation function of the drive head means that they are complex in their construction and thereby susceptible to contamination and damage. Encoding in this case means an additional safety function which must be released before the actuator can fulfill its function. I.e. the actuator not only engages into the drive head, i.e. for example into a switching wheel of the drive head, but first releases the additional safety devices or locking elements. In addition there is a latent constructionally-related disadvantage of the switch being circumvented by a further actuator which, when the protective element, i.e. the protective doors, are open for example is pushed into the drive head and can then put the system or the process back into operation. Described below are a number of examples of known internal drive heads of safety switches with separate actuators.

The redirection of the actuator movement into a positive opening of the switch contact or switch contacts is frequently undertaken by a switching wheel supported rotatably in the drive head containing one or more cutouts, into which the actuator engages to make a form fit and simultaneously is actively connected to a plunger actuating the switching contact. Thus, when the actuator is pulled out of the drive head, the switching contact or contacts is or are opened by the plunger. Such safety switches are described for example in DE 3943376 C1 and DE 33301090 C2.

Thus DE 3943376 C1 describes a safety switch for positively switching off the power supply on removal of a protective cover from a machine or the like and for switching on the power supply when the protective cover is closed by means of an actuator connected permanently to the protective cover. The actuator is introduced through an opening in the housing of the safety switch and is guided to a switching wheel of the drive head. In this case the actuator engages in at least one cutout of the switching wheel in order to turn the latter. However the switching wheel can only be turned if the locking elements preventing the switching wheel from turning are moved into an unlocked position. In order to bring this about the actuator has a special key-like shape.

When the actuator is pushed into the opening of the housing of the safety switch specific areas of the actuator push the locking elements aside before the actuator can be introduced into the cutout of the switching wheel. On further introduction the switching wheel is turned which allows the plunger which is effectively connected to be moved so that the switching contacts can be closed. If the actuator is removed from the safety switch, the switching wheel is turned in the other direction, which moves the plunger such that the switching contacts are released from one another, i.e. the switching contacts or the contact elements are positively opened.

The switching wheel encoding prevents an irregular switching on of the safety switch, e.g. by simple devices such as paperclips, pins, screwdrivers etc through the spring-loaded locking bolts arranged to the side of the switching wheel, which make a form fit connection into the switching wheel and thereby hold the latter in a defined end position. To enable the actuator to be introduced into the drive head the locking elements must first be pushed aside and thereby the switching wheel fixing released. Only then can the actuator be introduced fully into the drive head, the switching wheel turned and thus the opened break contact brought into the closed position.

Without switching wheel encoding, i.e. locking elements, the switching wheel, when the actuator is not introduced, can get into an undefined position through vibration and shock loads or through manipulation by the operating personnel and thereby represents an extremely high safety risk. A system or a process could then start despite the protective device being opened.

However all previously known switching wheel encodings or blocking elements have a number of disadvantages. The locking elements are embodied as bolts and move in linear guides which are very susceptible to dirt. Thus for example locking bolts can stick in their end positions and no longer be pushed back by the bolt springs when the actuator is withdrawn if the corresponding protective element has been closed for a longer period. Contamination gets in in such cases, especially through the opening in the housing of the safety switch, if the actuator is not pushed into the safety switch.

The locking elements are further susceptible to icing up because of the guides. Furthermore the locking elements, because of their construction, are always susceptible to grating, protruding ejectors, delay or similar and have us always subject to a latent danger of not being able to execute the encoding function. These types of locking elements are constructed as modules and consist of one or more locking members and additional springs which push the locking members into the locking position. The complex construction entails high installation and parts costs. The necessary guides cause high tool costs because of complicated tools.

SUMMARY

At least one embodiment of the invention creates a safety switch having a hold-closed function which overcomes the disadvantages given above. The safety switch should especially be embodied simply, robustly and at low-cost as well as being secure in relation to manipulations and contamination. In addition a method for positive opening or closing of contact elements of a safety switch having a hold-closed function is to be created which makes it possible for contact to be made simply and reliably or for the contact elements to be opened safely. Furthermore a simple method of using such a safety switch is to be created.

A safety switch is disclosed in at least one embodiment. A method for positive opening or closing of contact elements of a safety switch having a hold-closed function is disclosed in at least one embodiment. The use of such a safety switch is disclosed in at least one embodiment. Further features and details of the invention emerge from the subclaims, the description and also the drawings. Features and details which are described in conjunction with the safety switch of the embodiments naturally also apply in this case in conjunction with the method of the embodiments for positive opening or closing of contact elements of a safety switch having a hold-closed function as well as to the use of such a safety switch, and vice versa in each case.

In accordance with the first aspect of at least one embodiment of the invention, a safety switch is disclosed having a hold-closed function, featuring one movably held plunger element for positive opening or closing of contact elements, at least one locking element for locking and unlocking the plunger element and a housing whereby, for actuation of the plunger element by the actuation element, the plunger element is held so that it can be guided along an opening in the housing of the safety switch, with an end of the plunger element able to be bought into the effective connection with the actuation element outside the housing and the upper end of the plunger element being effectively connected inside the housing to the at least one locking element.

On the other hand, in at least one embodiment a safety switch is disclosed having a hold-closed function featuring a movably-held plunger element for positive opening or closing of contact elements, at least one locking element for locking and unlocking the plunger element and a housing, with the safety switch having a standard drive head which is arranged for actuation of the plunger element on the outside of the housing of the safety switch facing towards the plunger element, with the standard drive ahead able to be actuated and actuation element and with the plunger element being held so that it is able to be guided along an opening in the housing of the safety switch, with an end of the plunger element able to be bought into effective connection with the actuation element outside the housing and the upper end of the plunger element being effectively connected within the housing to the at least one locking element.

At the heart of the intervention of at least one embodiment is that no switching wheel is needed on the drive head within the safety switch and no separate actuator is needed. Instead of this constructively complex element the plunger element is actuated directly by the actuation element or a constructively-simply embodied standard drive head, as is known for position switches, is arranged on the safety switch.

In accordance with an example embodiment variant of the safety switch, the plunger element is held so that it can be guided along an opening in the housing of the safety switch. One end of the plunger element is able to be bought directly into direct contact with the actuation element outside the housing and can thus be moved vertically. The other end of the plunger element is in effective connection with the at least one locking element within the housing. If the locking element is in its locking position the plunger element cannot be moved so that the contact elements can also not be closed. If the locking element is unlocked, the actuation element can move the plunger element and the contact elements can be closed.

In accordance with the second example embodiment variant of the safety switch, this has a standard drive head which is arranged for actuating the plunger element on the outer side of the housing of the safety switch facing towards the plunger element. The standard drive head is able to be actuated by an actuation element and the plunger element is held to enable it to be guided along an opening in the housing of the safety switch. One end of the plunger element in this case is effectively connected to the standard drive head and the other end of the plunger element is in effective connection with the at least one locking element.

This standard drive head in this case is arranged on the safety switch, i.e. on the outer side of housing element of the safety switch, such that the standard drive head is in effective connection with the movably-supported plunger element of the safety switch. The movably-supported plunger element is guided in this case through an opening of the housing of the safety switch. Preferably the plunger element is held to enable it to be guided by devices within the safety switch or by the standard drive head. In particular the plunger element can slide in a sealed manner along the opening so that no contamination can get into the inside of the safety switch. The plunger element can also lie completely within the housing of the safety switch. In this case the plunger element is moved up and down by a separate element, generally a shaft. The separate element in this case is effectively connected to the plunger element and to the standard drive head arranged on the outer side of the housing of the safety switch. In this form of embodiment the separate element slides through the opening of the housing of the safety switch. Preferably the separate element is sealed so that no contamination can get into the inside of the safety switch.

The plunger element of the safety switch is used for positive opening or closing of the contact elements. The contact elements have a fixed contact and a movable contact coupled to the plunger element. It is also conceivable for a number of fixed contacts and a corresponding number of movable contacts to be provided. The standard drive head is able to be actuated by means of actuation element, for example a linear actuator or a cam. In such cases the actuation element is arranged on the standard drive head such that the actuation element actuates the standard drive head when the protective element in which the actuation element is typically arranged is moved or opened respectively. The safety switch in this case is a fixed component of a protective device, for example of a housing wall or a door case. I.e. the actuation element is arranged on a movable protective element which can securely close an opening in the protective device, as a rule a room or a housing. In another advantageous form of embodiment the actuation element can be arranged on the fixed component of the protective device, for example a housing wall or a door case, while the safety switch is arranged on the movable protective element.

In the state in which the movable protective element closes off the opening of the protective device and thereby protects a system arranged within the protective device, the contact elements of the safety switch are closed so that a current can flow over the latter. If the movable protective element is moved, for example a protective door is opened, the current flow should be interrupted, i.e. a positive opening of the contact elements of the safety switch should occur. This is made possible by the actuation element. For a movement of the protective element, for example a linear displacement, a rotational or a pivoting movement, the actuation element actuates the standard drive head. This in its turn actuates the plunger element of the safety switch which is pressed downwards by the standard drive head, i.e. in the direction of the inside of the housing of the safety switch. Through this movement of the plunger element the contact elements of the safety switch are opened and there is thus a forced interruption of current flow.

The safety switch features at least one locking element for locking and unlocking the plunger element. The at least one locking element is arranged in this case within the safety switch. In the locking state the locking element prevents a movement of the plunger element. In the unlocked state the locking element does not block the movement of the plunger elements so that the contact elements of the safety switch can be opened. The at least one locking element can typically be a spring-loaded locking element or a magnetically-operated locking element. Spring-loaded locking elements or magnetically-operated locking elements are known from the prior art. Other known locking elements can also be employed however.

The locking or unlocking of the locking element thus makes it possible to open or not open the protective element of the protective device which is protecting the system or a process. When the plunger element cannot be moved the standard drive head and thereby the protective element can also not be moved. If the locking element enables the movement of the plunger element, the standard drive head and thus the protective element, can be moved.

At least one embodiment of the invention is based on the idea that a safety switch in which a plunger element is supported movably and which has at least one locking element for blocking or releasing the movement of the plunger element is combined with a standard drive head arranged on the safety switch. This does away with a complicated separate actuator which must be introduced into the inside of the safety switch in order to actuate the latter. Furthermore no complicated switching wheel, with cutouts for the separate actuator is required. The housing of the safety switch so to speak forms the interface between the part of the safety switch in which the plunger elements, the at least one locking element and the contact elements are arranged and the standard drive head via which the plunger element can be movably actuated. The at least one locking element makes sure that the plunger element or the standard drive head can only be moved by the locking impulse and thus the protective element, for example the protective doors, can only be opened after the unlocking impulse.

Such a safety switch described above has a number of advantages. Standard drive heads are better protected against manipulation than separate actuators by virtue of their design. It is not possible for the safety switch to be circumvented by a further separate actuator or by screwdrivers, paperclips etc. Expensive encoding is also not necessary since doing away with the complicated switching wheel makes possible a markedly simpler construction compared to separate actuators. Standard drive heads do not project into the operating space like actuators of the prior art, which enables the danger of an accident to be reduced. Standard drive heads are less susceptible to contamination, icing up, damage etc. Furthermore standard drive heads can be constructed as robustly as required by virtue of their design and are not demanding as regards tolerances. The assignment of the actuation element, for example of the linear actuator, to the standard drive head is very much easier to arrange than with separate actuators, in which the actuator must engage precisely into the switching wheel and the lock of the drive head arranged in the safety switch. The large diversity of variants of standard drive heads enables these to be used for a very wide variety of applications.

The actuation element can be seen as a separate part. Preferably the actuation element is part of the safety switch however.

Especially advantageous is a safety switch in which the standard drive head is a roller plunger, a roller lever, an angled roller lever, a pivoted lever, a cup plunger, a ball plunger, a rod lever or a rotary drive. Standard drive heads embodied in this way can be actuated very simply. Furthermore these types of standard drive head are embodied very robustly. Preferably this type of safety switch is used in conjunction with sliding doors. Thus an actuation element, especially in the form of a linear actuator, can be arranged on a sliding door. The actuation element serves to actuate the standard drive head. I.e. if the sliding door is pushed the actuation element presses on the standard drive head which in its turn moves the plunger element directly or indirectly, especially pushes it into the interior of the safety switch. It is further conceivable for the actuation element to be arranged on a fixed component of the protective device to which the sliding door is movably attached, while the safety switch with the standard drive head is fixed to the movable sliding door.

Standard drive heads, such as cup plungers, roller plungers, roller levers and angled roller levers for drive heads are for example preferably used on sliding doors on which a linear actuator is often mounted for actuation of the safety switch. With such sliding doors small locking forces of the locking element of the safety switch are sufficient to guarantee a safe locking of the protective doors. Basically however any standard drive head can be blocked.

The actuation element can be embodied in different ways. An advantage of the actuation element to be used is that it can be embodied very simply compared to a separate actuator in order to actuator standard drive heads such as a roller plunger, a roller lever, an angled roller lever, a pivot lever, a cup plunger, a ball plunger, a rod lever or a rotary drive. Preferably the actuation element of the safety switch is a linear actuator, a protective door, a protective door frame, a protective flap or a protective barrier. A linear actuator can especially preferably be used with movable protective elements, such is sliding doors for example. The actuation element can further be embodied as a round or longitudinal cam. All elements which enable a standard drive head described above to be actuated can be used as actuation elements.

The standard drive head can be embodied for example from metal or plastic or from a combination of metal and plastic.

Further preferred is a safety switch in which the contact elements and the at least one locking element are arranged in the housing of the safety switch. The plunger element can be supported movably along an opening in the housing. The standard drive head is preferably releasably attached facing towards the plunger element on the outer side of the housing of the safety switch and is effectively connected to the plunger element. In this case the standard drive head is in direct effective connection with the plunger element of the safety switch.

As an alternative to this a safety switch is preferred in which the plunger element, the contact elements and the at least one locking element are arranged in a housing of the safety switch with a separate element also being provided which is supported movably along an opening in the housing and in which the standard drive head is attached releasably facing towards the separate element to the outer side of the housing of the safety switch, and in which the standard drive head is in effective connection with the separate element and the plunger element. In this form of embodiment the standard drive head is indirectly effectively connected, i.e. via the separate element, to the plunger element of the safety switch. The separate element thus forms the connection between the standard drive head and the plunger element. The separate element can for example be a shaft with an attachment option in each case at the ends of the shaft.

Advantageously the at least one locking element of the safety switch is embodied as a spring-loaded locking element or as a magnetically-operated locking element. Other locking elements can also be used.

In accordance with a second aspect of an embodiment of the invention the object is achieved on the one hand by a method for positive opening or closing of contact elements of a safety switch having a hold-closed function, with the safety switch having a movably-supported plunger element and at least one locking element for locking and unlocking the plunger element, with the plunger element being actuated by an actuation element, with the plunger element being held so that it can be guided along opening in the housing of the safety switch and with one end of the plunger element able to be brought into effective connection outside the housing with the actuation element and the other end of the plunger element being in effective connection with the at least one locking element inside the housing. The plunger element in this case is actuated directly by the actuation element. In this case the actuation element can move the plunger element vertically when the locking element enables movement.

On the other hand the object is achieved by a method for positive opening or closing of contact elements of a safety switch having a hold-closed function, with the safety switch featuring a movably-supported plunger element and at least one locking element for locking and unlocking the plunger element, with the plunger element being actuated by a standard drive head which is arranged on the outside of the housing of the safety switch facing towards the plunger element, with the plunger element being held so that it can be guided along an opening in the housing of the safety switch and with one end of the plunger element being effectively connected to the standard drive head and the other end of the plunger element being effectively connected to the at least one locking element and with the standard drive head being actuated by an actuation element.

The plunger element is moved by the movement of the standard drive head which for its part is actuated by the actuation element. The plunger element in this case can be moved directly by the standard drive head or indirectly via a separate element, for example a connecting shaft. In such a method makes it possible in a simple manner to positively open or closed the contact elements of a safety switch. The actuation of the standard drive head by the actuation element is simpler to carry out down the actuation of a drive head embodied with a switching wheel. The introduction of a specifically embodied actuator in the switching wheel of an internal drive head is much more difficult than the actuation of the standard drive head arranged outside the housing of the safety switch. The actuation of the standard drive head outside the housing of the safety switch is especially more simple because a standard drive head can be embodied much more robustly and the actuation element does not have to be threaded in through an opening in the housing of the safety switch. The actuation element looks after a movement of the lever, plunger or movable or rotatable bar arranged in the standard drive head which is effectively connected to the plunger element. The lever or the plunger or the bar of the standard drive head can be spring loaded. The plunger element can be blocked by at least one locking element. The blocking is not undertaken by the actuation element, as with actuators in accordance with the prior art, but separately. The at least one locking element prevents the plunger element being pushed down by the standard drive head if it has assumed its locking position. For positive opening of the contact elements the at least one locking element must first be unlocked. Only after the unlocking can the plunger element be moved by the standard drive head such that the contact elements open. The standard drive head does not need any encoding. The encoding of the at least one locking element can be arranged more simply since only one specific key for locking or unlocking the locking element is required. In safety switches known from the prior art a complex actuator is required which must be used for actuating the switching wheel of the internal drive head and simultaneously for locking or unlocking the locking element.

Preferred is a method for positive opening or closing of contact elements of a safety switch having a hold-closed function, with the safety switch having a movably-supported plunger element and at least one locking element for locking and unlocking the plunger element, with the plunger element being actuated by a standard drive head which is arranged on the safety switch and with the actuation of the standard drive head being undertaken by means of an actuation element in which for executing the method a safety switch in accordance with the first aspect of an embodiment of the invention is provided.

The last aspect of an embodiment of the invention relates to the use of such a safety switch in accordance with the first aspect of the invention for positive switching off of a circuit during opening of a movable protective element. The movable protective element closes or opens in such cases the access to the system or to a process. The system or the process should be positively switched off when the movable protective element is opened. The specially embodied safety switch takes care of this.

Preferred in this case is the use of the safety switch in which the safety switch is arranged on the protective element and the actuation element is arranged on a fixed component of a protective device to which the protective element is movably attached. As an alternative to this the safety switch can be used such that the actuation element is arranged on the protective element and the safety switch on a fixed component of a protective device, to which the protective element is movably attached. The fixed component of the protective device can for example be a wall element, which together with the protective element forms a closed housing or a closed room. Thus a part of the fixed component can be embodied as a door case for example. In this case the use of the safety switch is not restricted to these examples. Such a safety switch can be fixed to any possible protective element, such as a protective door, a protective grille, a protective flap, a sliding door, a protective barrier and other covers as well as the corresponding fixed components on which these protective elements are arranged.

BRIEF DESCRIPTION OF THE DRAWINGS

The invention will now be explained in greater detail based on a non-exclusive example embodiment which refers to the enclosed drawing. The drawing shows.

DETAILED DESCRIPTION OF THE EXAMPLE EMBODIMENTS

Figure 1:
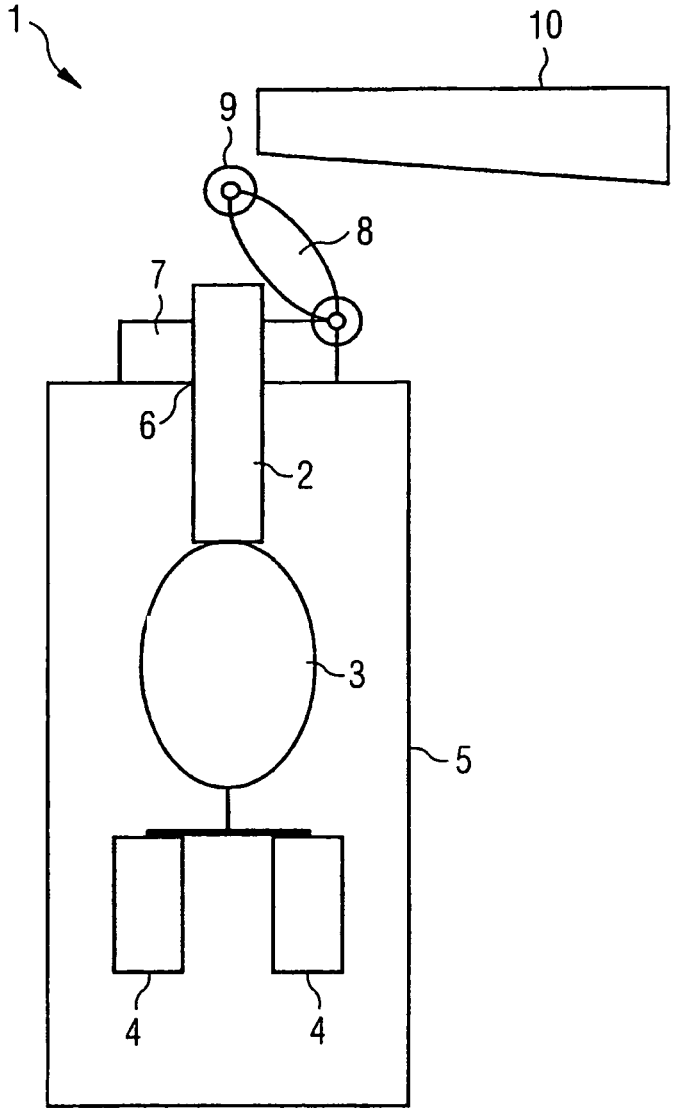
FIG. 1 a schematic diagram of a safety switch.

FIG. 1 shows a schematic diagram of a safety switch 1. The safety switch 1 features a plunger element 2 which can be guided movably through an opening 6 in a housing 5 of the safety switch 1. The safety switch 1 further features a locking element 3 which is arranged within the housing 5 of the safety switch 1. The locking element 3 can either block or release the movement of the plunger element 2, depending on its position. If the locking element 3 releases the movement of the plunger element and if the plunger element 2 is pushed into the inside of the safety switch 1, the contact elements 4 arranged within the safety switch 1 are opened.

The contact elements 4 have at least one movable contact coupled to the plunger element 2 and at least one fixed contact. In this case the at least one movable contact and the at least one fixed contact are connected conductively to one another when the plunger element assumes its end position in which it protrudes as far as possible out of the opening 6 of the housing 5 of the safety switch 1. If the plunger element 2 is moved by the standard drive head 7 arranged in the housing 5 of the safety switch 1 into the inside of the safety switch 1, the contact elements 4 open and the current flow is interrupted.

The standard drive heard 7 is assigned to the opening 6 in the housing 5 of the safety switch 1 and thereby to the movably-supported plunger element 2. The standard drive head 7 is embodied in this form of embodiment as a roller lever. In this case the standard drive head 7 features a movably articulated lever 8. At the free end of the lever 8 a roller 9 is provided.

A pivoting of the lever 8 of the standard drive head 7 presses the plunger elements 2 into the inside of the housing of the safety switch 1 which thereby opens the contact elements 4. The lever 8 of the standard drive head 7 is pivoted by an actuating element 10 being moved along the roller of the standard drive head 7. The special arrangement or embodiment of the actuation element 10 pivots the lever 8 of the standard drive head 7.

Figure 2:
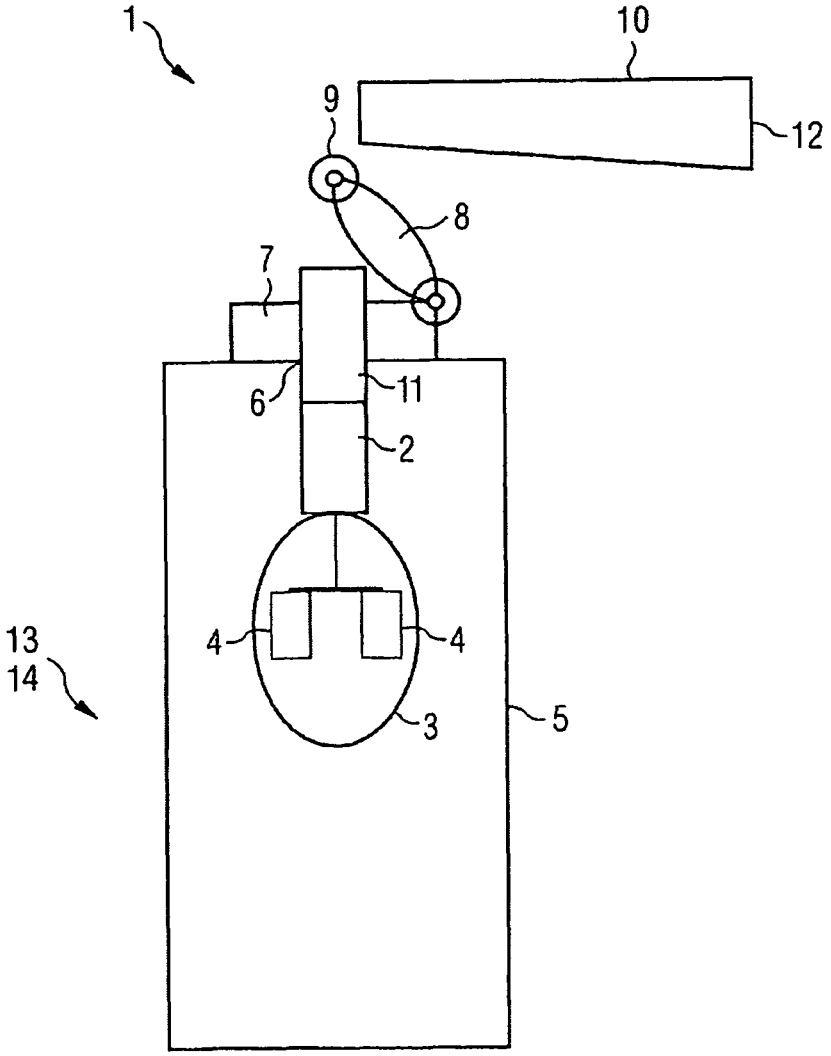
FIG. 2 is a schematic diagram of a safety switch.

As shown in FIGS. 1 and 2, the actuation element 10 is preferably attached to a movable protective element 12 and the safety switch 1 to a fixed component 13 of a protective device 14 on which the protective element 12 is movably arranged. On movement of the protective element 12 the actuation element 10 is guided along the roller 9 of the lever 8 of the standard drive head 7, whereby the actuation element 10 pivots the lever 8 as the actuation element 10 moves past it. In this case the lever 8 pushes the plunger element 2 through the opening 6 in the housing 5 of the safety switch 1 into the inside of the safety switch 1 and in doing so opens the contact elements 4. The movement of the plunger element 2 however only functions if the locking element 3 of the safety switch 1 is not blocking the plunger element 2. If the plunger element 2 is blocked by the locking element I the protective element 12, i.e. the protective doors for example, can accordingly not be opened in that the lever 8 of the standard drive head 7 cannot be pivoted.

FIG. 2 shows a schematic diagram of a safety switch. The protective element 12, fixed component 13 and protective device 14, discussed above, are illustrated in FIG. 2. In addition, FIG. 2 illustrates the contact elements 4 arranged in the locking element 3. Finally, FIG. 2 illustrates the plunger element 2 being moved up and down by a separate element 11 so that the plunger element 2 is completely within the housing 5 of the safety switch 1. The separate element 11 is effectively connected to the plunger element 2 and to the standard drive head 7 arranged on the outer side of the housing 5 of the safety switch 1. In this example embodiment, the separate element 11 slides through the opening 6 of the housing 5 of the safety switch 1. Preferably the separate element 11 is sealed so that no contamination can get into the inside of the safety switch 1.

Such a safety switch 1 having a hold-closed facilities holds the isolating protective device 14, i.e. the protective element 12, in the closed position. It is used whenever the hazardous machine function is not ended after opening the protective device 14 before a person can reach the point of danger, e.g. for long rundown times of the machine. The hold-closed facility device that the protective device 14 remains closed until the hazardous state is ended.

A further area of application for such a safety switch 1 having a hold-closed facility is machine protection. Safety switches having hold-closed facilities are frequently used if undefined interruptions of the manufacturing process have to be avoided for reasons of process safety.

Safety switches 1 having spring-actuated hold-closed facilities remain locked even if there is a power failure at the overall machine and thus keep protective doors blocked even during the shutdown phase of the machine. Because of this property they are preferred for personal protection applications over power-operated, i.e. for example magnetically-operated safety switches having hold-closed facilities. Magnetically-operated hold-closed devices are frequently used for machine protection.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A safety switch comprising:

a movably-held plunger element configured to open or close contact elements;

at least one locking element configured to lock and unlock the plunger element;

a drive head; and a housing, wherein, for actuation of the plunger element by an actuation element, the plunger element is configured to be guided along an opening in the housing of the safety switch, with a first end of the plunger element configured to extend outside the housing and continuously connect with the drive head and a second end of the plunger element configured to connect inside the housing with the at least one locking element, the first end being unenclosed in a first position.

2. The safety switch as claimed in claim 1, wherein the actuation element is part of the safety switch.

3. The safety switch as claimed in claim 1, wherein the actuation element is one of a linear actuator, a protective door, a protective door frame, a protective flap and a protective barrier.

4. The safety switch as claimed in claim 1, wherein the contact elements are in the at least one locking element in the housing of the safety switch.

5. The safety switch as claimed in claim 1, wherein the at least one locking element includes one of a spring-loaded locking element and a magnetically-operated locking element.

6. A method, comprising:

using the safety switch as claimed in claim 1 for switching off of a current circuit on opening of a movable protection element.

7. The method as claimed in claim 6, wherein one of the safety switch is on a protective element and the actuation element is on a fixed component of a protective device to which the protective element is movably attached, and the actuation element is on the protective element and the safety switch on a fixed component of a protective device to which the protective element is movably attached.

8. The method as claimed in claim 6, wherein the protection element is one of a protective door, a protective flap and a protective barrier.

9. A safety switch, comprising:

a movably-held plunger element configured to open or close contact elements;

at least one locking element configured to lock and unlock the plunger element;

a housing; and a standard drive head, arranged for actuating the plunger element on an outside of the housing of the safety switch facing the plunger element, the standard drive head configured to be actuated by an actuation element, and the plunger element is configured to be guided along an opening in the housing of the safety switch, with a first end of the plunger element configured to extend outside the housing and continuously connect with the drive head and a second end of the plunger element configured to connect inside the housing with the at least one locking element, the first end being unenclosed in a first position.

10. The safety switch as claimed in claim 9, wherein the plunger element is movably-guided by one of at least one device within the safety switch and the standard drive head.

11. The safety switch as claimed in claim 9, wherein the standard drive head is one of a roller plunger, a roller lever, an angled roller lever, a pivot lever, a cup plunger, a ball plunger, a rod lever and a rotary drive.

12. The safety switch as claimed in claim 9, wherein the plunger element, the contact elements and the at least one locking element are in a housing of the safety switch, a separate element is provided which is movably supported along an opening in the housing, the standard drive head is attached releasably, facing towards the separate element, to the housing of the safety switch and the standard drive head is configured to connect with the separate element and the plunger element.

13. The safety switch as claimed in claim 9, wherein the actuation element is part of the safety switch.

14. The safety switch as claimed in claim 9, wherein the actuation element is one of a linear actuator, a protective door, a protective door frame, a protective flap and a protective barrier.

15. The safety switch as claimed in claim 9, wherein the contact elements are in the at least one locking element in the housing of the safety switch.

16. The safety switch as claimed in claim 9, wherein the at least one locking element includes one of a spring-loaded locking element and a magnetically-operated locking element.

17. A method, comprising:

using the safety switch as claimed in claim 9 for switching off of a current circuit on opening of a movable protection element.

18. The method as claimed in claim 17, wherein one of the safety switch is on a protective element and the actuation element is on a fixed component of a protective device to which the protective element is movably attached, or the actuation element is on the protective element and the safety switch on a fixed component of a protective device to which the protective element is movably attached.

19. A method for opening or closing of contact elements of a safety switch, the safety switch including a movably-supported plunger element, a housing and at least one locking element for locking and unlocking the plunger element, the method comprising:

actuating the plunger element by an actuation element and a drive head; and holding the plunger element to be guidable along an opening in the housing of the safety switch, a first end of the plunger element configured to extend outside the housing and continuously connect to the drive head and a second end of the plunger element configured to connect inside the housing to the at least one locking element, the first end being unenclosed in a first position.

20. A method for opening or closing of contact elements of a safety switch, the safety switch including a movably-supported plunger element, a housing and at least one locking element for locking and unlocking the plunger element, the method comprising:

actuating the plunger element by a standard drive head, on an outer side of the housing of the safety switch facing the plunger element; and holding the plunger element to be moveable along an opening in the housing of the safety switch, a first end of the plunger element configured to continuously connect to the standard drive head and a second end of the plunger element configured to connect to the at least one locking element, the first end being unenclosed in a first position and extending outside the housing, the standard drive head configured to be actuated by way of an actuation element.

* * * * *